US007037161B2

(12) United States Patent
Yamanaka

(10) Patent No.: US 7,037,161 B2
(45) Date of Patent: May 2, 2006

(54) METHOD OF MANUFACTURING FLAT PANEL DISPLAYS UTILIZING A SURFACE TREATING LAYER

(75) Inventor: Hiroshi Yamanaka, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 6 days.

(21) Appl. No.: 10/838,336

(22) Filed: May 5, 2004

(65) Prior Publication Data

US 2005/0032454 A1 Feb. 10, 2005

(30) Foreign Application Priority Data

Aug. 8, 2003 (JP) ..... 2003-289799

(51) Int. Cl.
*H01J 9/12* (2006.01)

(52) U.S. Cl. ..... 445/49

(58) Field of Classification Search ..... 445/24, 445/25, 49–51, 58; 427/68, 562, 555
See application file for complete search history.

(56) References Cited

U.S. PATENT DOCUMENTS 5,135,826 A * 8/1992 Ritt et al. ..... 430/28
5,209,688 A * 5/1993 Nishigaki et al. ..... 445/24
5,474,867 A * 12/1995 Ritt et al. ..... 430/23
5,576,070 A * 11/1996 Yaniv ..... 427/510
6,805,601 B1 * 10/2004 Aoki et al. ..... 445/24
6,858,455 B1 * 2/2005 Guillom et al. ..... 438/20
6,910,933 B1 * 6/2005 Matsuo et al. ..... 445/24

FOREIGN PATENT DOCUMENTS

JP 11/273557 10/1999
JP 3395841 2/2003

* cited by examiner

*Primary Examiner*—Joseph Williams
*Assistant Examiner*—Dalei Dong
(74) *Attorney, Agent, or Firm*—Staas & Halsey LLP

(57) ABSTRACT

To enable formation of a pattern of constituent elements, arranged in correspondence with an arrangement of cells in a display region, as desired or required with a minimized quantity of the film material, a method of manufacturing a flat panel display is provided which includes printing on a substrate a surface treating material capable of partially enhancing the wettability of the substrate, in a predetermined pattern sufficient to encompass the eventually formed pattern of constituent elements of the flat panel display. Undercoats made of the surface treating material so printed is then patterned by irradiation of light. Thereafter, utilizing the undercoats, a film material is thereafter selectively deposited on the substrate to thereby complete the predetermined pattern of the constituent elements.

2 Claims, 2 Drawing Sheets

METHOD OF MANUFACTURING FLAT PANEL DISPLAYS UTILIZING A SURFACE TREATING LAYER

BACKGROUND OF THE INVENTION

1. Field of the Invention

The present invention relates to a method of manufacturing a flat panel display of a type having a pattern of constituent elements arranged in correspondence with an arrangement of cells in a display region.

2. Description of the Prior Art

In the course of mass production of flat panel displays (FPDs) such as, for example, plasma display panels, liquid crystal display panels and organic electroluminescence display panels, attempts have hitherto been made to minimize indirect materials of a kind utilized solely for the convenience of manufacture thereof. The indirect materials are, when intended products are completed, in most cases disposed of as wastes and, therefore, the need has been well recognized to minimize the indirect materials not only to avoid concomitant increase of the manufacturing cost, but also to avoid environmental contamination.

The Japanese Laid-open Patent Publication No. 11-273557, published in 1999, discloses the use of an ink jetting technique to form electrodes of the plasma display panel. The ink jetting technique in which an electroconductive inking material is jetted towards a substrate so as to depict a pattern of electrodes is considered economically efficient as compared with the photolithographic technique in which portions of a uniform layer of electrode material are removed to leave a pattern of electrodes. Also, as compared with the screen printing technique, the ink jetting technique is considered effective not only in facilitating accurate formation of the pattern of electrodes with high uniformity over the entire surface of a large size screen, but also substantially eliminating the need of replacement of screens, which would otherwise be performed frequently, resulting in reduction in cost and reduction in length of time required to complete the products.

However, the ink jetting technique involves the following problems when the pattern of electrodes for flat panel display is to be formed:

(1) Unless the support surface on which the electrode pattern is desired to be formed has an excellent wettability, the inking material being jetted tends to scatter and/or fluidize.

(2) Microscopic irregularities peculiar to those occurring when liquid droplets are deposited tend to be observed in edges of the electrode pattern.

As a technique effective to substantially eliminate the above discussed problems and to form a layer of inking material representing the electrode patterns having a smooth contour, the above mentioned patent publication suggests a method of masking, with a photoresist, an area other than the area onto which the inking material is deposited and a method of shaping the pattern edge by the use of exposure and development subsequent to formation of the electrode pattern with a photosensitive inking material.

The Japanese Patent No. 3395841 discloses a method of making a color filter for a liquid crystal display panel, which method includes forming on a substrate a photocatalyst containing layer, of which wettability varies when irradiated with energies, and irradiating the substrate with energies in a predetermined pattern to enhance the wettability of a portion of the photocatalyst containing layer and depositing a colored ink on the wettability enhanced portion of the photocatalyst containing layer. In other words, this Japanese patent discloses enhancement of the wettability of only a portion of the predetermined pattern formed on the support surface.

In the manufacture of the FPDs hitherto practiced, the use of the ink jetting technique is effective to reduce the amount of direct materials used, but a number of indirect materials are needed and/or special materials must be used to render the resultant electrode pattern to be neatly finished. Masking with the photoresist requires a substantial amount of resist materials so that the latter can be deposited on the entire area of the supporting surface, i.e., a substrate and, also, requires complicated process steps. The use of the photosensitive ink would undesirably recede the merit of reduction of the amount of the direct materials used. Yet, even where a film material effective to vary the wettability of the photocatalyst containing layer, discussed above, when irradiated with energies is employed, the film material in a quantity enough to cover the entire surface of the substrate uniformly is needed.

SUMMARY OF THE INVENTION

Accordingly, the present invention has for its primary object to enable formation of a pattern of constituent elements, arranged in correspondence with an arrangement of cells in a display region, as desired or required with a minimized quantity of the film material.

In order to accomplish this and other objects of the present invention, there is provided a method of manufacturing a flat display panel, which includes printing on a substrate a surface treating material of a kind capable of partially enhancing the wettability of the substrate, in a predetermined pattern sufficient to encompass the eventually formed pattern of constituent elements of the flat display panel. The surface treating material so printed forms an undercoat on the substrate which is subsequently patterned by irradiation of light. Thereafter, a film material eventually forming the constituent elements in a pattern on the substrate is selectively deposited on the substrate by the utilization of the undercoat to thereby complete the predetermined pattern of the constituent elements.

According to the present invention, since the area of the substrate on which the undercoat is formed is a localized surface area of the substrate, not the entire surface area of the substrate, the amount of the surface treating material used can advantageously be reduced to a value smaller than that that would be required to deposit the undercoat on the entire surface area of the substrate. The smaller the area of the substrate occupied by the constituent elements, the more savable the amount of the surface treating material.

Patterning of the undercoat on the substrate may be accomplished in various ways. For example, a technique of partially removing the undercoat by irradiation of a laser beam or a technique of partially modifying the undercoat by irradiation of ultraviolet rays of light may be employed. In particular, irradiation of the laser beam may be carried out according to either a delineating scheme or a pattern exposure scheme and irradiation of the ultraviolet rays of light may be carried out according to a pattern exposure scheme. For the patterning that is performed in the practice of the present invention, a highly precise patterning technique must be employed, rather than a mere pattern printing technique. The patterning performed in the practice of the present invention is effective to provide a highly precise pattern of the constituent elements on the substrate more accurately than that accomplished by the use of the pattern printing such as, for example, the screen printing.

Selective deposition of the film material on the patterned undercoat may be suitably carried out by the use of an ink jetting technique. Where the substrate has a high ink repellent property and the film material is of a kind that can be highly selectively deposited on the undercoat, a full surface printing process which can be practiced by the use of a coating apparatus such as, for example, a die coater can be suitably employed. This is because, since even though the inking material is applied to the entire surface area of the substrate, the inking material does not deposit on the surface area of the substrate other than that occupied by the undercoat, that is, the inking material can be deposited only on the undercoat, the amount of the inking material used is comparable to that used when the undercoat is selectively coated.

As discussed above, the present invention is advantageous in that the amount of the film material needed to form the constituent elements of the pattern arranged in conformity with an arrangement of cells on the screen can advantageously be minimized.

Specifically, since the amount of the film material needed to form the constituent elements of the predetermined pattern can advantageously be minimized, the present invention can bring about a contribution to reduction in cost of the flat display panel. Also, the present invention can find an application not only in formation of the electrodes employed in the plasma display panel, but also in formation of a light shielding pattern and/or color filters on the front substrate used in the plasma display panel, formation of fluorescent coatings used in the plasma display panel and formation of color filters used in a liquid crystal display panel.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

FIGS. 4A to 4C illustrate the sequence of formation of addressing electrodes employed in the plasma display panel, wherein FIG. 4A is a schematic front elevational view of a substrate, FIG. 4B is a schematic transverse view, on an enlarged scale, of the substrate being exposed to rays of light, and FIG. 4C is a view similar to FIG. 4B, showing the substrate onto which an inking material is jetted.

DESCRIPTION OF THE PREFERRED EMBODIMENTS

In the description of the present invention that follows, reference will be made to minimization of a film material used to form electrodes during the manufacture of a plasma display panel (PDP), one of the FPDs which emits light by the effect of gas discharge.

Figure 1:
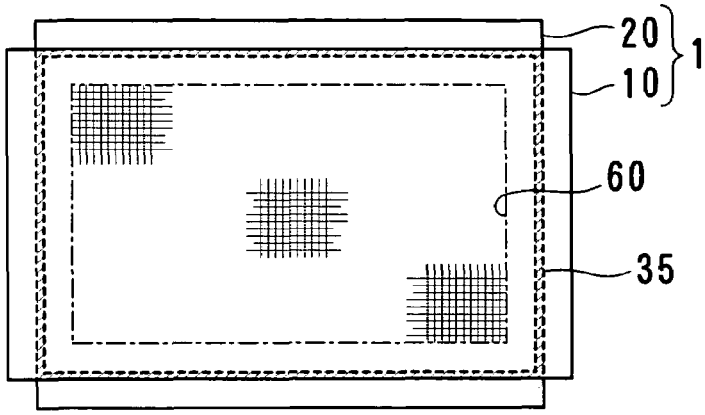
FIG. 1 is a schematic front elevational view of a plasma display panel according to a preferred embodiment of the present invention, showing the structure thereof.

Referring first to FIG. 1 showing, in a schematic representation, the structure of the plasma display panel according to the present invention, the plasma display panel 1 shown therein includes a front substrate structure 10, which is positioned forwardly of the rear substrate structure 20 with respect to the position of viewers, and a rear substrate structure 20 positioned rearwardly of the front substrate structure 10. Each of the front and rear substrate structures 10 and 20 is made up of a glass substrate 11 or 21 and at least one panel component both of a size larger than the screen size of the plasma display panel. The front and rear substrate structures 10 and 20 are disposed in face-to-face relation with each other having been placed one above the other and are jointed together with their four-sided peripheral edges sealed by a sealant 35. A sealed space defined between those substrate structures 10 and 20 is filled with a discharge gas of a kind well known to those skilled in the art.

So far shown in FIG. 1, the front substrate structure 10 has a width greater than that of the rear substrate structure 20, so that in an assembled condition in which those substrate structures 10 and 20 are jointed together in the manner described above, the front substrate structure 10 has its left and right portions protruding outwardly from the rear substrate structure 20. On the other hand, the rear substrate structure 20 has a height greater than that of the front substrate structure 10, so that in the assembled condition, the rear substrate structure 20 has its upper and lower portions protruding outwardly from the front substrate structure 10. As is well known to those skilled in the art, those portions of the respective substrate structures 10 and 20 that protrude outwardly as described are used to support thereon a flexible wiring plate (not shown) for electrical connection with an external drive circuit component. It is also well known to those skilled in the art that a surface area of the plasma display panel 1 where cells are arranged represents a screen 60.

Figure 2:
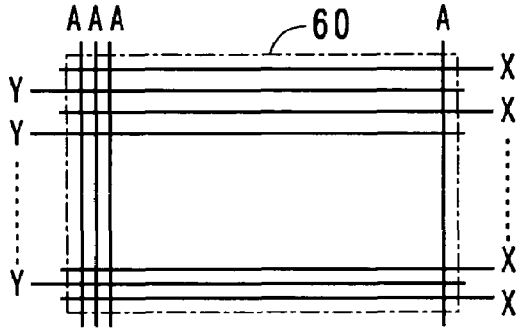
FIG. 2 is a schematic diagram showing a matrix of electrodes employed in the plasma display panel.

An array of electrodes arranged in a matrix is schematically shown in FIG. 2. The electrode matrix shown therein has a number of rows occupied by display electrodes X and display (or scanning) electrodes Y for generating display discharges, which extend parallel to each other and alternating with each other, and a number of columns occupied by addressing (or data) electrodes A which extend parallel to each other and perpendicular to the alternating display electrodes X and Y. The neighboring display electrodes X and Y form an electrode pair, and the total number of the electrode pairs shown is equal to the number n of the rows of the electrode matrix. Of the total display electrodes X and Y, the number of which is (n+1), the display electrode X disposed at one of opposite side edges of the electrode matrix and the display electrode Y immediately neighboring such display electrode X are utilized to effect a display at the leading row of the electrode matrix, whereas the display electrode X disposed at the other of the opposite side edges of the electrode matrix and the display electrode Y immediately neighboring such display electrode X are utilized to effect a display at the trailing row of the electrode matrix. The remaining display electrodes X and Y are utilized to effect a display at the neighboring two rows (odd-numbered and even-numbered rows) of the electrode matrix.

Figure 3:
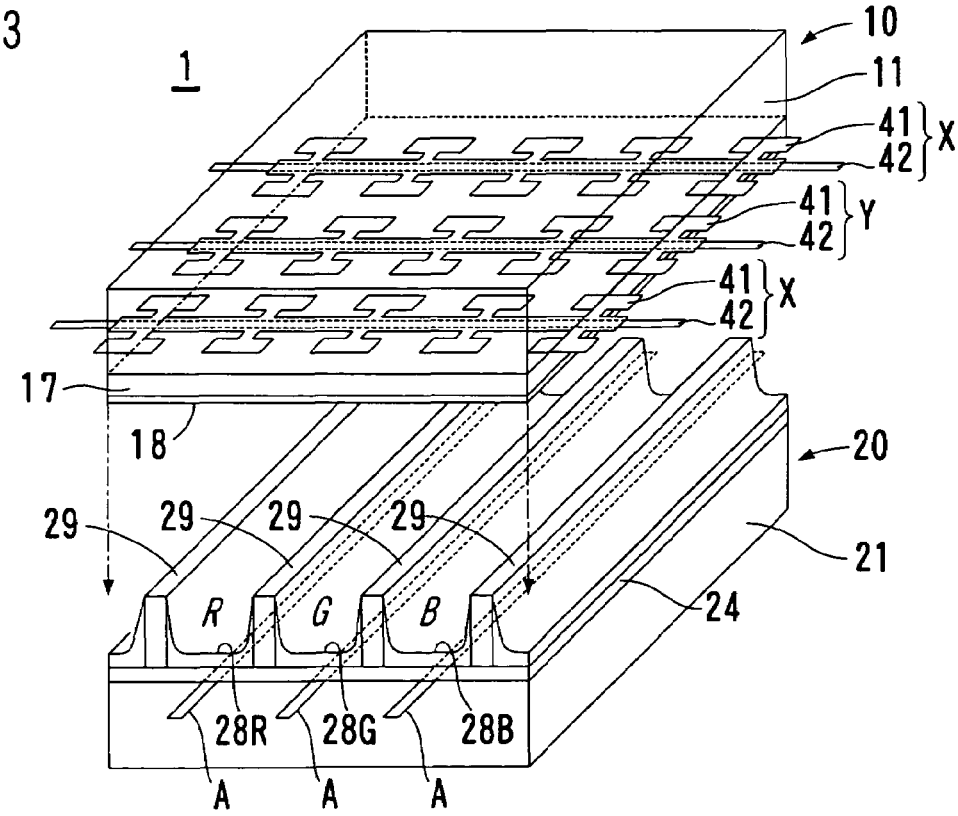
FIG. 3 is an exploded view of a portion of the plasma display panel, showing an array of cells employed therein.

The cell structure employed in the plasma display panel is shown in FIG. 3, in which for facilitating a better understanding the internal structure of the plasma display panel, only a portion of the plasma display panel 1 is shown in an exploded representation with the front and rear substrate structures 10 and 20 separated from each other.

The plasma display panel 1 shown in FIG. 3 is of an AC type having three-electrode surface discharge system. The front substrate structure 10 includes a glass substrate 11, an array of display electrodes X and Y referred to hereinabove, a dielectric layer 17 and a protective layer 18. Each of the display electrodes X and Y is made up of a transparent electroconductive film 41 for defining a surface discharge gap and a metal film 42 which is a bus conductor capable of reducing the electric resistance. The transparent electroconductive film 41 is patterned so as to have a generally T-shaped portion for the respective cell.

On the other hand, the rear substrate structure 20, positioned rearwardly of the front substrate structure 10, includes a glass substrate 21, an array of addressing electrodes A referred to hereinabove, a dielectric layer 24, partition walls 29 and phosphor layers 28R, 28G and 28B. Each of the addressing electrodes A is in the form of a thin straight electroconductive stripe of, for example, 30 μm in width. The partition walls 29 are in the form of a straight rib extending parallel to the respective addressing electrode A and protruding outwardly in a direction substantially perpendicular to the glass substrate 21 and is employed one for each gap between the neighboring addressing electrodes A. When the front and rear substrate structures 10 and 20 are sandwiched together, the partition walls 29 define gas discharge spaces one for each column of the display matrix.

The plasma display panel 1 of the structure described above operates in the following manner. As hereinbefore described, one of the display electrodes, for example, the display electrodes Y are utilized for selecting rows. When an addressing discharge takes place between the scanning electrode and the addressing electrode, addressing is carried out in which wall charge is developed on a surface of the dielectric layer 17 within each of the cells that is to be energized. After the addressing, trains of sustaining pulses of alternating polarities are applied successively to the display electrode pairs so that in response to application of each sustaining pulse, a display discharge in the form of a surface discharge can occur between the display electrodes within the cells to be excited. As a result of the display discharge, the discharge gases filled in the respective discharge spaces emit ultraviolet rays of light which subsequently impinge upon the corresponding phosphor layers 28R, 28G and 28B to excite the latter. It is to be noted that the characters R, G and B affixed to the reference numeral "28" stand for abbreviations of the respective colors, Red, Green and Blue, of light emitter from the phosphor layers when the latter are so excited.

Manufacture of the plasma display panel 1 of the structure discussed above may include a number of processes, i.e., a process of preparing the front and rear substrate structures 10 and 20 separately, a process of integrating the front and rear substrate structures 10 and 20 together with their peripheral edges sealed, and a process of cleaning the internal space and filling the internal space with discharge gases. During the preparation of the rear substrate structure 20, the addressing electrodes A are formed in the following manner and specifically as discussed in the following examples.

EXAMPLE 1

The addressing electrodes A are formed by the use of an ink jetting process in which an electroconductive inking material is jetted onto a support surface, i.e., the glass substrate 21, on which the addressing electrodes A are desired to be formed. The electroconductive inking material is in the form of a liquid medium having microparticles of silver (Ag) dispersed therein and also having a viscosity not higher than 20 mPas. Since the glass substrate 21 has no capability of absorbing and, hence, retaining deposits of the inking material on its surfaces as is well known to those skilled in the art, direct jetting of the inking material onto the glass substrate 21 would result in scattering of the jetted inking material to such an extent as to disturb formation of the desired pattern. To enable the pattern of the electrodes to be formed satisfactorily, a surface treatment is carried out to enhance the wettability of at least a surface portion of the glass substrate 21 onto which the inking material is to be jetted.

Figure 4A:
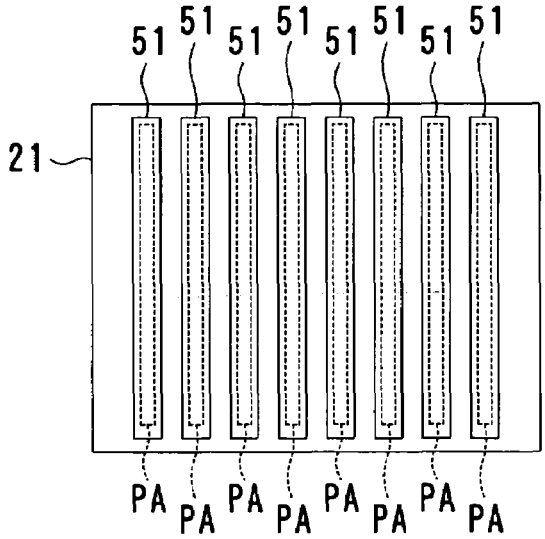
Figure 4B:
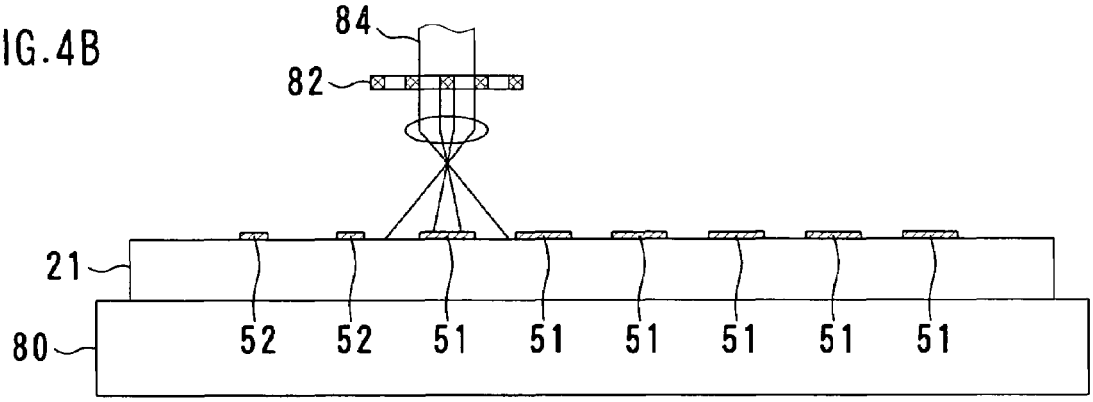
Figure 4C:
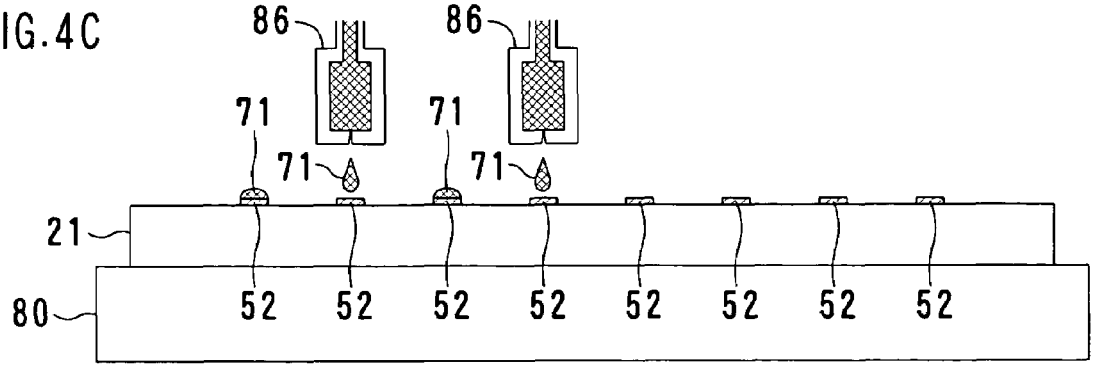

Referring now to FIGS. 4A to 4C showing the sequence of formation of the addressing electrodes A, a non-polarizing solvent such as, for example, silane coupling or tetradecane, that is known as a surface treating material effective to enhance the wettability with the electroconductive inking material, is printed in a predetermined pattern on the cleansed glass substrate 21 by the use of a screen printing technique or an ink jetting technique or with the use of a dispenser to thereby form undercoats 51 each having a size sufficient to encompass a respective pattern PA of the addressing electrode desired to be formed, as best shown in FIG. 4A. Specifically, each of the undercoats 51 so formed is of a size sufficient to cover the corresponding pattern PA of the addressing electrode, with a side drop of a few micrometers protruding laterally outwardly from the electrode pattern PA over the entire perimeter thereof. Preferably, the side drop is as small as possible, provided that the undercoat 51 can cover the corresponding electrode pattern PA in its entirety and should be determined depending on the accuracy that can be achieved with the screen printing technique.

As compared with the patterning achieved with the photolithography, the pattern printing with the organic material is effective to minimize the amount of the organic material needed and does not require use of any developing material and, therefore, the amount of the indirect material required can advantageously be minimized.

In the next step, the respective patterns of the undercoats 51 are shaped. As best shown in FIG. 4B, the glass substrate 21 bearing the undercoats 51 is placed on an X-Y table 80 capable of undergoing translational motion in two directions perpendicular to each other and is subsequently irradiated with a laser beam to decompose an unnecessary portion of each of the undercoats 51, i.e., to extinct the capability of enhancing the wettability on that unnecessary portion of each undercoat 51. Instead, that unnecessary portion of each undercoat 51 may be either removed or modified.

In the illustrated embodiment, for the laser beam, an excimer laser beam may be employed. Also, irradiation of the laser beam is carried out by the use of a light shielding mask 82 having a pattern that is a replica of the electrode pattern PA of the addressing electrodes. In the practice of this Example, the X-Y table 80 is driven to move relative to the incoming laser beam so that each undercoat 51 can be trimmed to a shape coinciding with the corresponding electrode pattern PA of the addressing electrode, leaving the respective trimmed undercoat 52 as shown in FIG. 4B and substantially as shown in FIG. 4C.

It is to be noted that the laser irradiation may be carried out according to the delineating scheme with no mask employed. It is also to be noted that instead of the glass substrate 21 being moved relative to the incoming laser beam as discussed above, the laser beam may be moved, i.e., scanned relative to the glass substrate 21.

Following the pattern shaping, and as shown in FIG. 4C, an ink jetting device has one or more jetting nozzles 86 placed in face-to-face relation with the respective undercoats 52 on the glass substrate 21 so that while the glass substrate 21 is moved relative to the jetting nozzle 86 in a direction lengthwise of the respective undercoats 52, the inking material jetted therefrom as indicated by 71 can be deposited on the respective undercoats 52 over the entire length thereof. In so doing, the size of droplets 71 of the inking material jetted from the nozzle 86 must be carefully chosen that deposits of the inking material on the undercoats 52 will not run off the edge of each undercoat 52.

As a matter of course, the use of the ink jetting device of a type having a plurality of jetting nozzles 86 such as shown in FIG. 4C is effective to maximize the productivity.

The ink jetting referred to above may be carried out cyclically until a desired or required film thickness of the ink deposit can be attained on each of the undercoats 52. Specifically, since in depositing the inking material each undercoat 52 has a positional selectivity, the deposits of the inking material on the undercoats 52 need not be sufficiently dried for each cycle of jetting of the inking material where the cyclical ink jetting is carried out. In other words, during the cyclic ink jetting, a cycle of ink jetting may be immediately followed by the next succeeding cycle of ink jetting even though the ink deposit formed as a result of the first cycle of ink jetting has not bet been dried sufficiently.

After the formation of the ink deposits of a desired pattern on the respective undercoats 52, baking is carried out to extinct an organic component contained in the ink deposits, thereby completing formation of the addressing electrodes A made of silver.

EXAMPLE 2

In place of the laser irradiation employed in the foregoing Example 1, a pattern exposure is carried out by the use of an ultraviolet lamp and a photomask to thereby accomplish the pattern shaping in which that unnecessary portion of each undercoat 51 is decomposed as hereinabove described.

EXAMPLE 3

In place of the formation of the ink deposits on the undercoats by the utilization of the ink jetting technique as in the foregoing Example 1, a full surface printing may be carried out with the use of a die coater to deposit the ink droplets 71 on only the undercoats 52. In such case, the electroconductive inking material is preferably of a kind difficult to deposit on the glass substrate 21, but alternatively the glass substrate 21 may be surface treated to enhance the ink repellent property prior to formation of the undercoats 52.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A method of manufacturing a flat panel display, which comprises:

preparing a glass substrate of a size determinative of the size of a display screen;

partially printing the glass substrate with a surface treating material to form a printed pattern of undercoats in an area encompassing a pattern of electrodes that are to be formed on the substrate;

irradiating the undercoats with rays of light effective to remove or modify portions of the undercoats other than necessary portions thereof which eventually form the electrodes, to thereby leave an effective pattern of the undercoats on the substrate, the effective pattern of the undercoats in a shape corresponding to the pattern of the electrodes; and selectively depositing on the undercoats a film material of a kind having a high propensity of being deposited on the undercoats than that on the substrate, to thereby form the electrodes.

2. The flat panel display manufacturing method as claimed in claim 1, wherein the selectively depositing comprises depositing electroconductive inking material on the undercoats by an ink jetting technique.

* * * * *